US010710388B2

(12) United States Patent
Biehler et al.

(10) Patent No.: US 10,710,388 B2
(45) Date of Patent: Jul. 14, 2020

(54) HEAT TRANSFER FILMS FOR THE DRY COATING OF SURFACES

(71) Applicants: BASF SE, Ludwigshafen (DE); LS Industrielacke GmbH, Essen (DE)

(72) Inventors: Manfred Biehler, Ilbesheim (DE); Dieter Litzcke, Essen (DE)

(73) Assignees: BASF SE, Ludwigshafen (DE); LS Industrielacke GmbH, Essen (DE)

( * ) Notice: Subject to any disclaimer, the term of this patent is extended or adjusted under 35 U.S.C. 154(b) by 0 days.

(21) Appl. No.: 16/389,144

(22) Filed: Apr. 19, 2019

(65) Prior Publication Data

US 2019/0315144 A1 Oct. 17, 2019

Related U.S. Application Data

(63) Continuation of application No. 14/917,980, filed as application No. PCT/EP2014/069895 on Sep. 18, 2014, now abandoned.

(30) Foreign Application Priority Data

Sep. 18, 2013 (EP) ..... 13185007

(51) Int. Cl.

| | |
|---|---|
| ***B41M 5/00*** | (2006.01) |
| ***B41M 3/00*** | (2006.01) |
| ***B44C 1/00*** | (2006.01) |
| ***B41M 5/382*** | (2006.01) |
| ***B41M 3/12*** | (2006.01) |
| ***B44C 1/17*** | (2006.01) |

(52) U.S. Cl.

CPC ..... *B41M 5/38242* (2013.01); *B41M 3/12* (2013.01); *B41M 5/38214* (2013.01); *B44C 1/1729* (2013.01); *B41M 2205/06* (2013.01); *B41M 2205/10* (2013.01); *B41M 2205/30* (2013.01); *B41M 2205/40* (2013.01)

(58) Field of Classification Search

CPC . B41M 5/00; B41M 5/30; B41M 5/38; B41M 5/38; B41M 5/382; B41M 5/382; B41M 5/3824; B41M 5/3824; B41M 5/38242; B41M 5/3821; B41M 5/3821; B41M 5/38214; B41M 3/00; B41M 3/10; B41M 3/12; B44C 1/00; B44C 1/10; B44C 1/17; B44C 1/17; B44C 1/172; B44C 1/172; B44C 1/1729

See application file for complete search history.

(56) References Cited

U.S. PATENT DOCUMENTS

| | | | | |
|---|---|---|---|---|
| 4,902,364 | A * | 2/1990 | Parker | B41M 3/12 156/233 |
| 6,194,044 | B1 * | 2/2001 | Stahl | B44C 1/105 112/439 |
| 2007/0066704 | A1 | 3/2007 | Schwalm et al. | |
| 2010/0215875 | A1 | 8/2010 | Yang et al. | |
| 2011/0189477 | A1 | 8/2011 | Miracle et al. | |
| 2012/0070595 | A1 | 3/2012 | Sloat et al. | |
| 2015/0041054 | A1 | 2/2015 | Hoffmuller et al. | |

FOREIGN PATENT DOCUMENTS

| | | | | |
|---|---|---|---|---|
| CN | 1214013 | A | 4/1999 | |
| DE | 20209576 | U1 | 8/2002 | |
| DE | 102010034039 | A1 | 2/2012 | |
| EP | 0210620 | A2 | 2/1987 | |
| EP | 573676 | A1 | 12/1993 | |
| EP | 1304235 | A1 | 4/2003 | |
| EP | 1527825 | A1 | 5/2005 | |
| EP | 1702767 | A2 | 9/2006 | |
| EP | 1970215 | A2 | 9/2008 | |
| EP | 2078618 | A2 | 7/2009 | |
| GB | 2357061 | A * | 6/2001 | B42D 25/364 |
| JP | 2004-339415 | A | 12/2004 | |
| JP | 2006-181791 | A | 7/2006 | |
| JP | 2012-011677 | A | 1/2012 | |
| WO | WO-2005/035460 | A1 | 4/2005 | |
| WO | WO-2006/005434 | A1 | 1/2006 | |
| WO | WO-2008/061930 | A1 | 5/2008 | |
| WO | WO-2011/012520 | A2 | 2/2011 | |
| WO | WO-2011/098514 | A1 | 8/2011 | |
| WO | WO-2013/019821 | A1 | 2/2013 | |

OTHER PUBLICATIONS

International Search Report, International Application No. PCT/EP2014/069895, dated Oct. 6, 2014.

* cited by examiner

*Primary Examiner* — Seyed Masoud Malekzadeh
*Assistant Examiner* — Matthew Hoover
(74) *Attorney, Agent, or Firm* — Marshall, Gerstein & Borun LLP

(57) ABSTRACT

A heat transfer film having a) a carrier film, b) at least one coating layer arranged directly on the carrier film, and c) at least one hot-sealable polymer adhesive layer is disclosed. The coating layer is based on a non-aqueous, radiation-curable, liquid composition which contains at least 60 wt %, based on the total weight of the composition, of curable constituents selected from organic oligomers which have ethylenically unsaturated double bonds. Use of the heat transfer films for the dry coating of surfaces, production of such heat transfer films, and methods for coating or lacquering surfaces of objects using the heat transfer films are also disclosed.

18 Claims, No Drawings

HEAT TRANSFER FILMS FOR THE DRY COATING OF SURFACES

CROSS-REFERENCE TO RELATED APPLICATIONS

This is a continuation application of U.S. application Ser. No. 14/917,980 filed Mar. 10, 2016, which is the U.S. national phase of International Application No. PCT/EP2014/069895, filed Sep. 18, 2014, which claims the benefit of European Patent application No. 13185007.5, filed Sep. 18, 2013.

DESCRIPTION

The present invention relates to thermal transfer foils and use of these for the dry coating of surfaces. The invention also relates to the production of these thermal transfer foils, and also to a process for the coating of surfaces of articles with use of the thermal transfer foils of the invention.

Surfaces of articles are usually coated by the wet coating process, i.e. a liquid coating material is applied to the surface that requires coating and is then dried, thus producing a layer of coating material on the surface. In the case of industrial coating, the coating is usually achieved on coating lines, and drying here generally requires relatively long drying sections, where the coating material is dried and hardened at comparatively high energy cost. These processes are therefore time-consuming and energy-intensive, and moreover have large manpower requirements. Furthermore, once the coating process has ended the coating equipment of the coating lines requires cleaning, and this generates stoppage times. Furthermore, the waste produced during the cleaning of the machines has to be discarded as special waste. Some two-component coating materials have a limited processing lifetime, and unused residues likewise have to be discarded as special waste.

There have been various reports concerning coating techniques in which hot-stamping foils, also known as thermal transfer foils, are used to transfer one or more layers of coating material onto the surface that requires coating. Said foils comprise a backing foil on which there are one or more polymer layers and optionally an adhesive layer arranged. During the coating process, pressure and/or heat is/are used to transfer the at least one polymer layer from the backing foil onto the surface that requires coating. The at least one polymer layer thus forms a layer of coating material on the surface that requires coating, without any need for use of organic solvents during the coating procedure. It is possible to achieve a very wide variety of designs of the surface reproducibly in a very simple manner by combining decorative layers and layers of coating material.

EP 573676 describes a process for the application of a coating material with decorative color effect to a substrate, for example to wood surfaces or plastics surfaces, by using a foil which has a decorative layer applied to a backing with release properties, and a partially crosslinked layer of coating material applied to the decorative layer. The layer of coating material on the foil is applied to the surface that requires coating and is transferred with the decorative layer to the surface by use of pressure and elevated temperature, and at the same time here the layer of coating material is hardened. Coating materials used comprise thermally curable coating materials. Major restrictions apply to the selection of the substrates because high temperatures are needed in the process during curing of the coating material.

EP 1702767 discloses thermal transfer foils which have a decorative layer arranged on a backing layer and a heat-activatable adhesive layer arranged on the decorative layer, where the backing layer has a metallic functional layer which is in direct contact with the decorative layer and which facilitates the release of the decorative layer from the backing layer and thus is intended to ensure improved transfer of the decorative layer to the substrate. Restrictions apply to the decorative layer by virtue of the metallization.

EP 1970215 in turn describes thermal transfer foils which are suitable for the coating of surfaces and which have a basal layer of coating material bonded to a backing foil and simultaneously functioning as release layer, a colored decorative layer, and a transfer layer with adhesive effect, where the layers are based on aqueous coating systems which comprise thermally drying aqueous polymer dispersions as binders. The surface hardness and the abrasion resistance of the resultant coatings are often unsatisfactory. Coatings with high abrasion resistance cannot be obtained with the thermal transfer foils described in that document.

EP 2078618 describes thermal transfer foils which have at least one top layer of coating material arranged on a backing foil, and a thermally activatable adhesive layer, where the top layer of coating material is preferably based on an aqueous coating composition which comprises a dispersed polyurethane curable by UV radiation. Although the thermal transfer foils described in that document give improved surface hardness when compared with thermal transfer foil having layers of coating material based on thermally drying aqueous polymer dispersions. This hardness is unsatisfactory for some applications. Furthermore, the use of aqueous coating compositions is associated with increased drying cost during the production of the thermal transfer foils. The coatings described in that document are not always satisfactory in relation to abrasion resistance values and surface properties. Coatings with high abrasion resistance cannot be obtained with the thermal transfer foils described in that document.

Surprisingly, it has been found that thermal transfer foils are particularly suitable for the coating of surfaces if the foils have, arranged on the backing foil, at least one layer of coating material which is based on a non-aqueous radiation-curable, liquid composition which comprises 60% by weight, in particular at least 70% by weight, based on the total weight of the composition, of crosslinkable constituents selected from organic oligomers which have ethylenically unsaturated double bonds and mixtures of said oligomers with monomers which have at least one ethylenically unsaturated double bond and which have a heat-sealable polymeric adhesive layer (4) which comprises at least one radiation-curable constituent: the use of these thermal transfer foils gives particularly robust surfaces which adhere particularly well to the coated substrates. Furthermore, the use of non-aqueous, radiation-curable coating compositions with a high proportion of crosslinkable constituents permits specific adaptation of the thermal transfer foil to suit various underlay materials, namely not only those that are hard but also those that are highly resilient. A difference from thermal transfer foils with layers of coating material based on thermally curable coating compositions is that the thermal stress to which the material that requires coating is subjected during the transfer of the layer(s) of coating material to the surface that requires coating is comparatively small, since final curing can easily be achieved by irradiation of the coated surface with high-energy radiation such as UV radiation or electron beams, and no subsequent heat-conditioning is necessary.

Because of the use of liquid compositions with a high proportion of crosslinkable constituents which are hardened by high-energy radiation, in particular by UV radiation, there is moreover no need for long drying times during the production of the thermal transfer foils, and production of these can therefore be carried out very efficiently.

Accordingly, the present invention firstly provides a thermal transfer foil (1) comprising:

a) a backing foil (2), b) at least one, for example one, two, or three, layer(s) (3) of coating material arranged directly on the backing foil (2), c) at least one, in particular precisely one, heat-sealable, polymeric adhesive layer (4), where the layer of coating material is based on a non-aqueous, radiation-curable, liquid composition which comprises at least 60% by weight, in particular at least 70% by weight based on the total weight of the composition, of curable constituents selected from organic oligomers which have ethylenically unsaturated double bonds and mixtures of said oligomers with monomers which have at least one ethylenically unsaturated double bond, and where the heat-sealable polymeric adhesive layer (4) comprises at least one radiation-curable constituent.

The invention also provides the production, comprising the following steps, of the thermal transfer foils of the invention:

i. the application of the non-aqueous, radiation-curable, liquid composition, where a coating curable by high-energy radiation is obtained;

ii. irradiation, by high-energy radiation, in particular by UV light, of the curable coating obtained in step i., where the layer (3) of coating material is obtained;

iii. optionally application of a decorative layer to the curable coating or to the layer (3) of coating material; and iv. application of the heat-sealable, polymeric adhesive layer (4).

The invention further provides the use of the thermal transfer foils of the invention for the dry coating of articles.

The invention also provides a process for the coating of surfaces of articles, comprising the following steps:

a) application of the thermal transfer foil (1) of the invention with the adhesive layer to the surface requiring coating;

b) heat-sealing of the transfer foil, where a surface coated with the transfer foil is obtained;

c) irradiation, with high-energy radiation, in particular with UV radiation or electron beams, specifically with UV radiation, of the surface coated with the transfer foil; and d) optionally release of the backing foil (2).

The thermal transfer foils of the invention have at least one layer of coating material which is based on a non-aqueous, radiation-curable, liquid composition. This means that the layer(s) of coating material is/are obtained by curing of one or more layers of the liquid radiation-curable composition by irradiation with high-energy radiation, in particular with UV radiation. Layers of coating material of the invention, produced with use of non-aqueous radiation-curable liquid compositions, are unlike layers of coating material based on aqueous coating compositions with radiation-curable binders in that they have more uniform structure and crosslinking within the layer of coating material and fewer defects. This is probably attributable to a difference from the aqueous coating compositions consisting in formation of a coherent phase by the curable, i.e. polymerizable, constituents in the uncured coating, so that the covalent bonds formed between the curable constituents of the composition during irradiation can develop uniformly within the layer.

The radiation-curable, liquid compositions used for the production of the layer of coating material comprise at least 60% by weight, in particular at least 70% by weight, e.g. from 60 to 99% by weight, in particular from 70 to 95% by weight, based on the total weight of the composition, of curable constituents which have ethylenically unsaturated double bonds. The selection of the constituents here is preferably such that the composition comprises from 1.5 to 8 mols, in particular from 2.0 to 7 mols, and specifically from 2.5 to 6.5 mols, of ethylenically unsaturated double bonds per kg of the coating composition.

The ethylenically unsaturated double bonds of the curable constituents of the liquid, radiation-curable composition which forms the layer of coating material preferably take the form of acrylic groups, methacrylic groups, allyl groups, fumaric acid groups, maleic acid groups, and/or maleic anhydride groups, in particular to an extent of at least 90% or 100% in the form of acrylic or methacrylic groups, and specifically in the form of acrylic groups, based on the total amount of the ethylenically unsaturated double bonds comprised in the composition. The acrylic and methacrylic groups can take the form of (meth)acrylamide groups or of (meth)acrylate groups, preference being given here to the latter. In particular, the curable constituents of the radiation-curable composition which forms the layer of coating material comprise at least 90% or 100% of acrylate groups, based on the total amount of the ethylenically unsaturated double bonds comprised in the composition.

In the invention, the liquid, radiation-curable compositions used to produce the layer of coating material comprise at least one oligomer which has ethylenically unsaturated double bonds. The average functionality of the oligomers is preferably in the range from 1.5 to 10, in particular in the range from 2 to 8.5, i.e. the number of ethylenically unsaturated double bonds per molecule is on average in the range from 1.5 to 10, and in particular in the range from 2 to 8.5. Mixtures of various oligomers with different functionality are also suitable, where the average functionality is preferably in the range from 1.5 to 10, in particular in the range from 2 to 8.5.

The fundamental structure of the oligomers is typically linear or branched, bearing on average more than one ethylenically unsaturated double bond, preferably in the form of the abovementioned acrylic groups, methacrylic groups, allyl groups, fumaric acid groups, maleic acid groups, and/or maleic anhydride groups, in particular in the form of acrylic or methacrylic groups, where the ethylenically unsaturated double bonds can have bonding by way of a linker to the fundamental structure or are a constituent of the fundamental structure. Suitable oligomers are especially oligomers from the group of the polyethers, polyesters, polyurethanes, and epoxide-based oligomers. Preference is given to oligomers which have in essence no aromatic structural units, and also the mixtures of oligomers having aromatic groups and oligomers without aromatic groups.

In particular, the oligomers are selected from polyether (meth)acrylates, i.e. polyethers having acrylic or methacrylic groups, polyester (meth)acrylates, i.e. polyesters having acrylic or methacrylic groups, epoxy (meth)acrylates, i.e. reaction products of polyepoxides with hydroxy-functionalized acrylic or methacrylic compounds, urethane (meth)acrylates, i.e. oligomers which have a (poly)urethane structure and have acrylic or methacrylic groups, for example reaction products of polyisocyanates with hydroxy-functionalized acrylic or methacrylic compounds, and unsaturated polyester resins, i.e. polyesters which have a plurality of ethylenically unsaturated double bonds preferably present in the polymer structure, e.g. condensates of maleic acid or fumaric acid with aliphatic di- or polyols, and mixtures of these.

Unlike the monomers which can likewise be comprised in these curable compositions, the oligomers typically have a molar mass (number average) of at least 400 g/mol, in particular at least 500 g/mol, e.g. in the range from 400 to 4000 g/mol, and in particular in the range from 500 to 2000 g/mol. In contrast, the monomers typically have molar masses below 400 g/mol, e.g. in the range from 100 to <400 g/mol.

Suitable polyether (meth)acrylates are especially aliphatic polyethers, in particular poly($C_2$-$C_4$)-alkylene ethers having on average from 2 to 4 acrylate or methacrylate groups. Examples here are the following Laromer® grades: PO33F, LR8863, GPTA, LR8967, LR8962, LR9007 from BASF SE, some of which are blends with monomers.

Suitable polyester (meth)acrylates are especially aliphatic polyesters having on average from 2 to 6 acrylate or methacrylate groups. Examples here are the following Laromer® grades: PE55F, PE56F, PE46T, LR9004, PE9024, PE9045, PE44F, LR8800, LR8907, LR9032, PE9074, PE9079, PE9084 from BASF SE, some of which are blends with monomers.

Suitable polyurethane acrylates are especially compounds which contain urethane groups and which have on average from 2 to 10, in particular from 2 to 8.5, acrylate or methacrylate groups, and which are preferably obtainable by reaction of aromatic or aliphatic di- or oligoisocyanates with hydroxyalkyl acrylates or with hydroxyalkyl methacrylates. Examples here are the following Laromer® grades: UA19T, UA9028, UA9030, LR8987, UA9029, UA9033, UA9047, UA9048, UA9050, UA9072, UA9065, and UA9073 from BASF SE, some of which are blends with monomers.

In preferred embodiments of the invention, the radiation-curable, liquid composition which forms the layer of coating material comprises at least one oligomer selected from the following: urethane acrylates and polyester acrylates, and mixtures of these, and also optionally comprises one or more monomers.

In particular embodiments of the invention, the radiation-curable, liquid composition which forms the layer of coating material comprises at least one urethane acrylate and optionally one or more monomers.

In other particular embodiments of the invention, the radiation-curable, liquid composition which forms the layer of coating material comprises at least one polyester acrylate and optionally one or more monomers.

In specific embodiments of the invention, the radiation-curable, liquid composition which forms the layer of coating material comprises at least one urethane acrylate and at least one polyester acrylate, and optionally one or more monomers.

In other specific embodiments of the invention, the radiation-curable, liquid composition which forms the layer of coating material comprises at least one aliphatic urethane acrylate and at least one aromatic urethane acrylate, or at least two different aliphatic urethane acrylates, and optionally one or more monomers.

In other specific embodiments of the invention, the radiation-curable, liquid composition which forms the layer of coating material comprises at least one aliphatic urethane acrylate, at least one aromatic urethane acrylate, and at least one polyester acrylate, and optionally one or more monomers.

The crosslinkable constituents of the radiation-curable, liquid composition used to produce the layer of coating material can comprise, alongside the oligomers having ethylenically unsaturated double bonds, one or more monomers, which are also called reactive diluents. The molar masses of the monomers are typically below 400 g/mol, e.g. in the range from 100 to <400 g/mol. Suitable monomers generally have from 1 to 6 ethylenically unsaturated double bonds per molecule, in particular from 2 to 4. The ethylenically unsaturated double bonds here preferably take the form of the abovementioned acrylic groups, methacrylic groups, allyl groups, fumaric acid groups, maleic acid groups, and/or maleic anhydride groups, in particular take the form of acrylic or methacrylic groups, and specifically take the form of acrylate groups.

Preferred monomers are selected from esters of acrylic acid with mono- to hexahydric, in particular di- to tetrahydric aliphatic or cycloaliphatic alcohols which preferably have from 2 to 20 carbon atoms, examples being monoesters of acrylic acid with $C_1$-$C_{20}$-alkanols, benzyl alcohol, furfuryl alcohol, tetrahydrofurfuryl alcohol, (5-ethyl-1,3-dioxan-5-yl)methanol, phenoxyethanol, 1,4-butanediol, or 4-tert.-butylcyclohexanol; diesters of acrylic acid with ethylene glycol, 1,3-propanediol, 1,2-propanediol, 1,4-butanediol, 1,6-hexanediol, diethylene glycol, triethylene glycol, dipropylene glycol, or tripropylene glycol; triester of acrylic acid with trimethylolpropane or pentaerythritol, and also the tetraester of acrylic acid with pentaerythritol. Particular examples of suitable monomers are trimethylolpropane diacrylate, trimethylolpropane triacrylate, ethylene glycol diacrylate, butanediol diacrylate, hexanediol diacrylate, dipropylene glycol diacrylate, tripropylene glycol diacrylate, phenoxyethyl acrylate, furfuryl acrylate, tetrahydrofurfuryl acrylate, 4-tert-butylcyclohexyl acrylate, 4-hydroxybutyl acrylate, and trimethylolformal monoacrylate (the (5-ethyl-1,3-dioxan-5-yl)methyl ester of acrylic acid).

In preferred embodiments of the invention, the radiation-curable, liquid composition which forms the layer of coating material comprises at least one oligomer, e.g. 1, 2, or 3 oligomers, in particular at least one, e.g. 1, 2, or 3, of the oligomers mentioned as preferred, and at least one monomer, e.g. 1, 2, or 3 monomers, in particular at least 1, e.g. 1, 2, or 3, of the monomers mentioned as preferred. In these compositions, the oligomer preferably forms the main constituent of the curable constituents of the composition, i.e. the oligomer(s) make(s) up at least 50% by weight, in particular at least 60% by weight, based on the total amount of oligomer and monomer. The ratio by weight of the oligomer to monomer is in particular in the range from 1:1 to 20:1, and specifically in the range from 3:2 to 10:1.

In other, likewise preferred embodiments of the invention, the radiation-curable, liquid composition used to produce the layer of coating material comprises exclusively or almost exclusively, i.e. to an extent of at least 90% by weight, in particular at least 95% by weight, specifically at least 99% by weight, based on the total amount of radiation-curable constituents of the composition, one or more oligomers, e.g. 2, 3, or 4 oligomers, in particular 2, 3, or 4 of the oligomers mentioned as preferred. The proportion of the monomers is then accordingly at most 10% by weight, in particular at most 5% by weight, specifically at most 1% by weight, or 0% by weight, based on the total amount of radiation-curable constituents of the composition. It is preferable that these compositions comprise at least one polyester acrylate and/or polyurethane acrylate, and at least one polyether acrylate.

The radiation-curable, liquid composition used to produce the layer of coating material generally comprises, alongside the curable constituents, one or more other constituents, such as photoinitiators, inert fillers, abrasives, leveling aids, colorant constituents, in particular color pigments, organic solvents, and the like. In the invention, said constituents make up not more than 40% by weight, in particular not more than 30% by weight, e.g. from 1 to 40% by weight, in particular from 5 to 30% by weight, based on the total weight of the radiation-curable, liquid composition. It is preferable that the radiation-curable, liquid composition comprises no, or not more than 10% by weight, based on its total weight, of non-polymerizable volatile constituents. The meaning of volatile constituents here is those substances that have a boiling point or a vaporization point below 250° C. at atmospheric pressure, for example organic solvents.

It is preferable that the radiation-curable, liquid composition used to produce the layer of coating material comprises at least one photoinitiator. Photoinitiators are substances which decompose on irradiation with UV radiation, i.e. light of wavelength below 420 nm, in particular below 400 nm, to form free radicals, and thus initiate polymerization of the ethylenically unsaturated double bonds. It is preferable that the radiation-curable, liquid composition comprises at least one photoinitiator which has at least one absorption band having a maximum in the range from 220 to 420 nm, in particular in the range from 240 to 400 nm, coupled to the initiation of the decomposition process. It is preferable that the non-aqueous, liquid, radiation-curable composition comprises at least one photoinitiator which has at least one absorption band with a maximum in the range from 220 to 420 nm, in particular with a maximum in the range from 240 to 400 nm.

Examples of suitable photoinitiators are

- alpha-hydroxyalkylphenones and alpha-dialkoxyacetophenones, such as 1-hydroxycyclohexyl phenyl ketone, 2-hydroxy-2-methyl-1-phenyl-1-propanone, 2-hydroxy-1-{4-[4-(2-hydroxy-2-methylpropionyl)benzyl]phenyl}-2-methylpropan-1-one, 2-hydroxy-1-[4-(2-hydroxyethoxy)phenyl]-2-methyl-1-propanone, or 2,2-dimethoxy-1-phenylethanone;
- phenylglyoxalic ester such as methyl phenylglyoxalate;
- benzophenones such as benzophenone, 2-hydroxybenzophenone, 3-hydroxybenzophenone, 4-hydroxybenzophenone, 2-methylbenzophenone, 3-methylbenzophenone, 4-methylbenzophenone, 2,4-dimethylbenzophenone, 3,4-dimethylbenzophenone, 2,5-dimethylbenzophenone, 4-benzoylbiphenyl, or 4-methoxybenzophenone;
- benzyl derivates such s benzyl, 4,4'-dimethylbenzyl, and benzyl dimethyl ketal;
- benzoins such as benzoin, benzoin ethyl ether, benzoin isopropyl ether, and benzoin methyl ether;
- acylphosphine oxides such as 2,4,6-trimethylbenzoyldiphenylphosphine oxide, ethoxy(phenyl)phosphoryl(2,4,6-trimethylphenyl)methanone, and also bis(2,4,6-trimethylbenzoyl)phenylphosphine oxide;
- titanocenes such as the product marketed by BASF SE as Irgacure® 784,
- oxime esters such as the product marketed by BASF SE as Irgacure® OXE01 and OXE02,
- alpha-aminoalkylphenones such as 2-methyl-1-[4(methylthio)phenyl-2-morpholinopropan-1-one, 2-(4-methylbenzyl)-2-dimethylamino-1-(4-morpholinophenyl)-1-butanone, or 2-benzyl-2-dimethylamino-1-(4-morpholinophenyl)-1-butanone.

Preferred photoinitiators are especially selected from the groups of the alpha-hydroxyalkylphenones, alpha-dialkoxyacetophenones, phenylglyoxalic esters, benzophenones, benzoins, and acylphosphine oxides.

It is preferable that the liquid, radiation-curable composition comprises at least one photoinitiator which has an absorption band with a maximum $\lambda_{max}$ in the range from 230 to 340 nm.

It is preferable that the non-aqueous, liquid, radiation-curable composition used to produce the layer of coating material comprises at least two photoinitiators which differ from one another and in which the maxima of the absorption bands differ, preferably by at least 40 nm, and in particular by at least 60 nm.

In particular, this non-aqueous, liquid, radiation-curable composition comprises a mixture of at least two photoinitiators which differ from one another, where at least one photoinitiator (hereinafter photoinitiator I) has an absorption band with a maximum $\lambda_{max}$ in the range from 340 to 420 nm, and specifically in the range from 360 to 420 nm, and where at least one other photoinitiator (hereinafter photoinitiator II) has an absorption band with a maximum $\lambda_{max}$ in the range from 220 to 340, and specifically in the range from 230 to 320 nm. It is preferable that the ratio by weight of the total amount of photoinitiators I to the total amount of photoinitiators II is in the range from 2:1 to 1:20.

Preferred photoinitiators which have an absorption band with a maximum $\lambda_{max}$ in the range from 220 to 340, and specifically in the range from 230 to 320 nm, are the abovementioned alpha-hydroxyalkylphenones, alpha-dialkoxyacetophenones, phenylglyoxalic esters, benzophenones, and benzoins.

Preferred photoinitiators which have an absorption band with a maximum $\lambda_{max}$ in the range from 340 to 420 nm, and specifically in the range from 360 to 420 nm, are the abovementioned acylphosphine oxides.

In preferred embodiments, the photoinitiators comprise at least one alpha-hydroxyalkylphenone or alpha-dialkoxyacetophenone, and at least one acylphosphine oxide, and also optionally one phenylglyoxalic ester, and optionally one benzophenone. It is preferable that the ratio by weight of acylphosphine oxide to alpha-hydroxyalkylphenone and, respectively, alpha-dialkoxyacetophenone is in the range from 2:1 to 1:20.

The total amount of photoinitiators is typically in the range from 0.5 to 10% by weight, in particular from 1 to 5% by weight, based on the total weight of the non-aqueous, liquid, radiation-curable composition.

The non-aqueous, liquid, radiation-curable compositions of the invention can also be formulated without initiator, in particular when the subsequent curing takes place by means of electron beams.

The non-aqueous, liquid, radiation-curable compositions can moreover comprise one or more fillers, i.e. solid particulate constituents not soluble in the oligomers and in the monomers. Among these are especially aluminum oxides, for example in the form of corundum, and also silicon dioxide, such as fumed silica and synthetic, amorphous silica, e.g. precipitated silica. The average particle sizes of the fillers (weight averages) can vary widely and are typically in the range from 1 nm to 100 μm, in particular in the range from 10 nm to 50 μm, depending on the nature of the filler. The total amount of filler will generally not exceed 40% by weight, in particular 30% by weight, based on the total weight of the composition, and is typically, if the filler is comprised, in the range from 1 to 39.5% by weight, and in particular in the range from 2 to 29% by weight.

It is preferable that the non-aqueous, liquid, radiation-curable compositions comprise one or more abrasives. Abrasives are fillers which give the layer of coating material increased surface hardness and improved abrasion resistance. Among these are especially corundum, powdered quartz, glass powders, e.g. glass flakes, and nanoscale silicas.

The non-aqueous, liquid, radiation-curable compositions can comprise, alongside the above, one or more other additives, for example leveling aids, e.g. siloxane-containing polymers such as polyether siloxane copolymers, and also UV stabilizers, e.g. sterically hindered amines (known as HALS stabilizers).

Typical constitutions of the non-aqueous, liquid, radiation-curable compositions used to produce the layer of coating material are given in tables A1, A2, and A3 below.

TABLE A1

| Raw material | Amount [% by wt.][1)] |
|---|---|
| Urethane acrylate, functionality about 2.0 to 6.0 | from 15 to 30 |
| Polyester acrylate, functionality from 3.0 to 3.5 | from 5 to 15 |
| Trimethylolpropane formal monoacrylate | from 5 to 15 |
| Trimethylolpropane triacrylate | from 10 to 20 |
| Dipropylene glycol diacrylate | from 10 to 20 |
| Aliphatic urethane acrylate, functionality from 1.5 to 3.5 | from 3 to 15 |
| Aluminum oxide (corundum) | from 20 to 30 |
| Fumed silica | from 0.1 to 5 |
| Phenylglyoxylate | from 0.5 to 3 |
| Acylphosphine oxide | from 0.2 to 1 |
| alpha-Hydroxyalkylphenone | from 0.5 to 3 |

[1)]based on the total weight of the composition

TABLE A2

| Raw material | Amount [% by wt.][1)] |
|---|---|
| Urethane acrylate, functionality about 2.0 to 6.0 | from 20 to 35 |
| Aliphatic urethane acrylate, functionality from 1.5 to 2.0 | from 12 to 25 |
| Trimethylolpropane formal monoacrylate | from 5 to 15 |
| Phenoxyethyl acrylate | from 10 to 20 |
| Dipropylene glycol diacrylate | from 10 to 20 |
| Synthetic silica | from 5 to 15 |
| Fumed silica | from 0.1 to 5 |
| Leveling aid (e.g. polyether siloxane) | from 0.2 to 5 |
| Phenylglyoxylate | from 0.5 to 3 |
| Acylphosphine oxide | from 0.1 to 0.5 |
| alpha-Hydroxyalkylphenone | from 0.5 to 3 |
| Benzophenone | from 0.5 to 3 |

[1)]based on the total weight of the composition

TABLE A3

| Raw material | Amount [% by wt.][1)] |
|---|---|
| Mixture of two or three polyester acrylates, average functionality from 2.0 to 4.0 | from 40 to 65 |
| Trimethylolpropane formal monoacrylate | from 5 to 20 |
| Acrylate of an ethoxylated phenol | from 5 to 20 |
| Dipropylene glycol diacrylate | from 5 to 20 |

TABLE A3-continued

| Raw material | Amount [% by wt.][1)] |
|---|---|
| Fumed silica | from 1 to 10 |
| Leveling aid (e.g. polyether siloxane) | from 0.2 to 5 |
| Phenylglyoxylate | from 0.5 to 3 |
| Acylphosphine oxide | from 0.1 to 1 |
| alpha-Hydroxyalkylphenone | from 0.5 to 3 |
| Benzophenone | from 0.5 to 3 |

[1)]based on the total weight of the composition

The thermal transfer foils of the invention can have one or more layers of coating material arranged on top of one another which are based in the invention on the non-aqueous, liquid, radiation-curable compositions described above.

The total thickness of the layer of coating material, i.e. in the case of a plurality of layers of coating material the sum of all of the layer thicknesses, is typically in the range from 10 to 120 μm, in particular in the range from 30 to 80 μm. In the case of one layer, the thickness of the layer of coating material is therefore preferably in the range from 10 to 120 μm, in particular in the range from 30 to 80 μm. In the case of a plurality of layers, the individual layer thicknesses are typically in the range from 10 to 100 μm, in particular in the range from 20 to 70 μm.

In one first embodiment of the invention, the thermal transfer foil of the invention comprises precisely one layer of coating material arranged on the backing foil.

In another embodiment, the thermal transfer foil of the invention comprises one layer of coating material arranged on the backing foil, and also one or more, e.g. one or two further, layers of coating material which are based on the non-aqueous, liquid, radiation-curable compositions described above. The arrangement can have the layers of coating material directly on top of one another. Between two layers of coating material there can also be a decorative layer provided, in order to give the article coated with the thermal transfer foil a colored design.

The thicknesses of decorative layers are typically in the range from 0.5 to 5 μm, in particular in the range from 0.5 to 2.5 μm, and specifically in the range from 1 to 1.5 μm.

The thermal transfer foils of the invention moreover have at least one polymeric adhesive layer, in particular precisely one adhesive layer. Either the arrangement has the adhesive layer directly on the layer of coating material, or in the case of a plurality of layers of coating material directly on the uppermost layer of coating material or there can also be a decorative layer provided between the layer of coating material and the adhesive layer.

In the invention, the adhesive layer is heat-sealable, i.e. is non-tacky at room temperature and develops its adhesive effect only on heating. It has proven advantageous here for the adhesive layer to comprise at least one constituent that is radiation-curable, i.e. crosslinks on exposure to high-energy radiation, for example on irradiation with UV light or electron beams. This constituent typically involves organic oligomers or polymers which have ethylenically unsaturated double bonds.

It is preferable that the heat-sealable adhesive layer of the invention comprises at least one polymer as main constituent. The polymer can itself be radiation-curable, or have been blended with one or more radiation-curable oligomers or polymers which have ethylenically unsaturated double bonds.

In a preferred embodiment, the polymers which form the main constituent of the heat-sealable adhesive layer are crosslinkable, i.e. crosslink on heating and/or through exposure to high-energy radiation, for example on irradiation with UV light, and with formation of covalent bonds between the polymer chains.

In an embodiment that has proven particularly advantageous, the adhesive layer comprises not only oligomeric and/or polymeric constituents which can be crosslinked by heating but also constituents which can be crosslinked through exposure to high-energy radiation. This can be achieved by way of example in that the adhesive layer comprises not only polymers which crosslink on heating but also oligomers or polymers which are crosslinked through exposure to high-energy radiation. The adhesive layer can also comprise what are known as dual-cure polymers, i.e. polymers which crosslink not only on exposure to high-energy radiation but also on heating.

In a preferred embodiment the adhesive layer comprises at least one water-insoluble polymer that is usually used for the production of adhesive layers and that in particular is selected from straight acrylate polymers, styrene-acrylate polymers, polyurethanes, in particular polyester urethanes and polyether urethanes, and that is a physically drying or self-crosslinking polymer, and also comprises at least one radiation-curing oligomer or polymer.

Physically drying polymers are polymers that during drying form a solid polymer film in which the polymer chains are in uncrosslinked form. Self-crosslinking polymers are polymers that during drying form a solid polymer film in which the polymer chains are in crosslinked form. Self-crosslinking polymers have reactive functional groups, for example hydroxy groups, carboxy groups, isocyanate groups, blocked isocyanate groups, ketocarbonyl groups, or epoxy groups which can react with one another or with the reactive groups of a crosslinking agent to form covalent bonds.

In a particularly preferred embodiment, the adhesive layer comprises at least one water-insoluble polymer selected from polyurethanes, in particular polyester urethanes and polyether urethanes, and that is a physically drying or self-crosslinking polymer, and also comprises at least one radiation-curing oligomer or polymer.

In an embodiment that is likewise particularly preferred, the adhesive layer comprises at least one water-insoluble polymer selected from self-crosslinking straight acrylate polymers and self-crosslinking styrene-acrylate polymers, and also comprises at least one radiation-curing oligomer or polymer.

In an embodiment that is likewise particularly preferred, the adhesive layer comprises at least one water-insoluble polymer selected from self-crosslinking straight acrylate polymers and self-crosslinking styrene-acrylate polymers, and comprises at least one water-insoluble polymer selected from polyurethanes, in particular polyester urethanes and polyether urethanes, and that is a physically drying or self-crosslinking polymer, and also comprises at least one radiation-curing oligomer or polymer.

The radiation-curable oligomers and polymers of the adhesive layer are in principle oligomers and polymers which have ethylenically unsaturated double bonds. It is preferable that at least 90% or 100% of these double bonds, based on the entire quantity of the ethylenically unsaturated double bonds, take the form of acrylic or methacrylic groups, and specifically take the form of acrylic groups. The acrylic and methacrylic groups can take the form of (meth) acrylamide groups or of (meth)acrylate groups, preference being given to the latter. In particular, at least 90% or 100% of the radiation-curable constituents of the adhesive layer, based on the entire quantity of the ethylenically unsaturated double bonds comprised in the adhesive layer, have acrylate groups.

It is preferable that the average functionality of the radiation-curable oligomers and polymers of the adhesive layer is in the range from 2 to 20, in particular in the range from 2 to 10, i.e. the average number of ethylenically unsaturated double bonds per molecule is in the range from 2 to 20 and in particular in the range from 2 to 10. Mixtures of various oligomers and, respectively, polymers with different functionality, where the average functionality is preferably in the range from 2 to 20, in particular in the range from 2 to 10, are also suitable.

In particular, the radiation-curable oligomers and polymers of the adhesive layer are selected from polyether (meth)acrylates, polyester (meth)acrylates, epoxy (meth) acrylates, urethane (meth)acrylates, for example reaction products of polyisocyanates with hydroxy-functionalized acrylic or methacrylic compounds, and unsaturated polyester resins.

Specifically, the radiation-curable oligomers and polymers of the adhesive layer are selected from polyether (meth)acrylates, epoxy (meth)acrylates and urethane (meth) acrylates.

Especially suitable polyurethane acrylates are polymers which contain urethane groups and have an average number of from 2 to 10, in particular from 2 to 8.5, acrylate or methacrylate groups, in particular polyether urethane acrylates, and which are preferably obtainable via reaction of polyether urethanes comprising isocyanate groups with hydroxyalkyl acrylates or hydroxyalkyl methacrylates. Examples here are the Laromer® grades LR 8949, LR 8983 and LR 9005 from BASF SE.

In an embodiment that has proven advantageous moreover the polymers which preferably form the main constituent of the heat-sealable adhesive layer have a glass transition temperature Tg in the uncrosslinked condition in the range from −60 to 90° C., in particular from 0 to 90° C., determined by means of differential scanning calorimetry (DSC) in accordance with ASTM D3418, and/or semicrystalline polymers with a melting point in the range from −60 to 90° C., in particular from 0 to 90° C., determined by means of DSC, are used. To the extent that an adhesive composition comprises a plurality of polymers, these can also have different glass transition temperatures in the uncrosslinked state. It is then preferable that at least one portion, in particular at least 30% by weight of said polymers, based on the total quantity of the polymer constituents of the adhesive composition, has a glass transition temperature Tg in the range from 0 to 90° C. in the uncrosslinked state, in particular in the range from 20 to 90° C.

Adhesive compositions for the production of heat-sealable polymer layers are familiar to the person skilled in the art and can be purchased or can be produced by blending of commercially available raw materials for adhesives in accordance with known guideline formulations. Preference is given to liquid adhesive compositions. In principle, solvent-based adhesives and water-based adhesives are suitable.

It is preferable that the adhesive layer (4) is based on at least one aqueous polymer dispersion, i.e. water-based adhesives are used for the production of the adhesive layer, i.e. adhesives which comprise the polymers and optionally oligomers in the form of aqueous polymer dispersion. Preference is given to liquid, water-based adhesive compositions which comprise not more than 10% by weight of volatile, organic, non-polymerizable constituents such as organic solvents.

Suitable polymer dispersions are especially self-crosslinking aqueous polymer dispersions, i.e. aqueous polymer dispersions which comprise a reactive dispersed polymer and optionally a crosslinking agent which reacts with the reactive groups of the reactive polymer on drying and/or heating with bond formation. Suitable materials are especially self-crosslinking aqueous straight acrylate dispersions, self-crosslinking aqueous styrene-acrylate dispersions, and self-crosslinking aqueous polyurethane dispersions, in particular aqueous polyether urethane dispersions and polyester urethane dispersions.

Straight acrylate dispersions are aqueous polymer dispersions based on alkyl acrylates and on alkyl methacrylates. Styrene acrylates are aqueous polymer dispersions based on styrene, on alkyl acrylates, and optionally on alkyl methacrylates. Polyurethane dispersions are aqueous dispersions of polyurethanes, in particular of polyether urethanes and polyester urethanes.

The polymers in the self-crosslinking aqueous polymer dispersions have reactive functional groups, for example hydroxyl groups, carboxyl groups, isocyanate groups, blocked isocyanate groups, ketocarbonyl groups, or epoxy groups, where these can react with the reactive groups of the crosslinking agent with formation of covalent bonds. Suitable crosslinking agents are compounds having at least two reactive groups, for example hydrazide groups, amino groups, hydroxyl groups, epoxy groups, isocyanate groups. Examples of self-crosslinking aqueous polymer dispersions are the products obtainable with trademarks Luhydran® A 849, Acronal® 849 S, Joncryl® 8330, Joncryl® 8383 from BASF SE, and Alberdingk® AC 2742 from Alberdingk Boley GmbH.

UV-crosslinkable polymer dispersions are also especially suitable aqueous polymer dispersions, these being polymer dispersions which comprise a dispersed polymer which has polymerizable ethylenically unsaturated double bonds that preferably take the form of the abovementioned acrylic groups, methacrylic groups, allyl groups, fumaric acid groups, maleic acid groups, and/or maleic anhydride groups, in particular taking the form of acrylic or methacrylic groups, where the ethylenically unsaturated double bonds can have bonding by way of a linker to the fundamental structure or are a constituent of the fundamental structure. Examples of suitable UV-crosslinkable aqueous polymer dispersions are aqueous dispersions of polyester acrylates, of urethane acrylates, and of epoxy acrylates, for example those marketed by BASF with trademarks Laromer® PE22WN, PE55WN, LR8949, LR8983, LR9005, UA9060, UA9095, and UA9064.

The aqueous adhesive composition in the invention comprises, alongside the polymer of a physically drying or self-crosslinking polymer dispersion, at least one radiation-curable constituent which is generally selected among the abovementioned polymers and oligomers having ethylenically unsaturated double bonds, and which preferably likewise takes the form of a dispersion.

The radiation-curable oligomers and polymers of the aqueous adhesive composition are in particular oligomers and polymers where at least 90% or 100% of the double bonds in these, based on the total quantity of the ethylenically unsaturated double bonds, take the form of acrylic or methacrylic groups, and specifically take the form of acrylic groups. The acrylic and methacrylic groups can take the form of (meth)acrylamide or (meth)acrylate groups, preference being given here to the latter.

It is preferable that the average functionality of the radiation-curable oligomers and polymers of the aqueous adhesive composition is in the range from 2 to 20, in particular in the range from 2 to 10, i.e. the average number of ethylenically unsaturated double bonds per molecule is in the range from 2 to 20 and in particular in the range from 2 to 10. Mixtures of various oligomers and, respectively, polymers with different functionality, where the average functionality is preferably in the range from 2 to 20, in particular in the range from 2 to 10, are also suitable.

In particular, the radiation-curable oligomers and polymers of the aqueous adhesive composition are selected from polyether (meth)acrylates, polyester (meth)acrylates, epoxy (meth)acrylates, urethane (meth)acrylates, and unsaturated polyester resins.

Specifically, the radiation-curable oligomers and polymers of the aqueous adhesive composition are selected from polyether (meth)acrylates, epoxy (meth)acrylates and polyurethane (meth)acrylates.

Especially suitable polyurethane acrylates are polymers which contain urethane groups and have an average number of from 2 to 10, in particular from 2 to 8.5, acrylate or methacrylate groups, and which are preferably obtainable via reaction of polyurethanes comprising isocyanate groups with hydroxyalkyl acrylates or hydroxyalkyl methacrylates. Examples here are the Laromer® grades LR 8949, LR 8983 and LR 9005 from BASF SE.

Other materials also especially suitable are mixtures of at least two different aqueous polymer dispersions, in particular mixtures of at least one aqueous UV-crosslinkable polymer dispersion, e.g. of an aqueous urethane acrylate dispersion and/or of an aqueous epoxy acrylate dispersion, and of at least one self-crosslinking aqueous polymer dispersion, e.g. of a self-crosslinking aqueous dispersion of straight acrylate, of styrene-acrylate or of polyurethane.

The adhesive compositions used for the production of the polymeric adhesive layer can comprise the additions conventionally used for this purpose, for example waxes, tackifier resins, antifoams, leveling aids, surfactants, means of pH adjustment, and one or more of the abovementioned fillers, and also UV stabilizers, e.g. sterically hindered amines (known as HALS stabilizers).

To the extent that the adhesive composition used for the production of the polymeric adhesive layer comprises a polymer curable by UV radiation, it generally also comprises at least one photoinitiator, generally selected among the abovementioned alpha-hydroxyalkylphenones, alpha-dialkoxyacetophenones, phenylglyoxalic esters, benzophenones, benzyl derivatives, acylphosphine oxides, oxime esters, alpha-amino-alkylphenones, and benzoins. Preferred photoinitiators are especially those selected from the groups of the alpha-hydroxyalkylphenones, alpha-dialkoxyacetophenones, phenylglyoxalic esters, benzophenones, benzoins, and acylphosphine oxides.

To the extent that the adhesive composition used for the production of the polymeric adhesive layer comprises a polymer curable by UV radiation, it preferably comprises at least one photoinitiator which has an absorption band with a maximum $\lambda_{max}$ in the range from 230 to 340 nm. In particular, it comprises at least two photoinitiators different from one another in which the maxima of the absorption bands differ, preferably by at least 40 nm, and in particular by at least 60 nm. In particularly preferred embodiments, the photoinitiators comprise at least one alpha-hydroxyalkylphenone or alpha-dialkoxyacetophenone, and at least one acylphosphine oxide, and also optionally one phenylglyoxalic ester, and optionally one benzophenone. It is preferable that the ratio by weight of acylphosphine oxide to alpha-hydroxyalkylphenone and, respectively, alpha-dialkoxyacetophenone is in the range from 2:1 to 1:20. The total amount of photoinitiators is typically in the range from 0.5 to 10% by weight, in particular from 1 to 5% by weight, based on the total weight of the adhesive composition used for the production of the polymeric adhesive layer.

Examples of typical adhesive compositions are the compositions stated below, where all of the parts are percentages by weight, based on the total weight of the composition:

| Adhesive composition 1 (UV-curable, unpigmented) | |
|---|---|
| from 30 to 70 parts | of a self-crosslinking aqueous acrylate dispersion (50% by weight) |
| from 10 to 50 parts | of a radiation-curable polyurethane acrylate dispersion (40-50% by weight) |
| from 5 to 10 parts | of a hydrophobized fumed silica |
| from 5 to 10 parts | of a nonionic wax dispersion |
| from 1.5 to 3 parts | of a blend of an alpha-hydroxyalkylphenone and benzophenone |
| from 0.5 to 1 part | of an acylphosphine oxide |
| and also optionally the following constituents | |
| from 0 to 20 parts | of water |
| from 0.8 to 1.5 parts | of a mineral-containing antifoam |
| from 0.4 to 1.2 parts | of a polyether siloxane copolymer |
| from 0.5 to 1.0 part | of a fluorosurfactant-containing leveling agent |
| from 2 to 4 parts | of butyl glycol as film-forming aid |
| from 0.3 to 0.5 part | of a polyurethane thickener |

| Adhesive composition 2 (UV-curable, unpigmented) | |
|---|---|
| from 75 to 95 parts | of a radiation-curable aqueous polyether urethane acrylate dispersion (from 40 to 50% by weight) |
| from 0.8 to 1.5 parts | of a mineral-containing antifoam |
| from 5 to 10 parts | of a hydrophobized fumed silica |
| from 5 to 10 parts | of a nonionic wax dispersion |
| from 1.5 to 3 parts | of a blend of an alpha-hydroxyalkylphenone and benzophenone |
| and also optionally the following constituents | |
| from 0.4 to 1.2 parts | of a polyether siloxane copolymer |
| from 0.5 to 1.0 parts | of a fluorosurfactant-containing leveling agent |
| from 2 to 5 parts | of water |
| from 2 to 4 parts | of butyl glycol as film-forming aid |
| from 0.3 to 0.5 part | of a polyurethane thickener |

| Adhesive composition 3 (UV-curable, pigmented) | |
|---|---|
| from 60 to 70 parts | of a radiation-curable aqueous polyether urethane acrylate dispersion (from 40 to 50% by weight) |
| from 15 to 25 parts | of titanium dioxide |
| from 0.3 to 0.9 part | of dispersion additive of a polymeric alkylolammonium salt |
| from 5 to 10 parts | of an organic matting agent based on a polymethylurea resin |
| from 3 to 5 parts | of a hydrophobized fumed silica |
| from 2 to 6 parts | of a nonionic wax dispersion |
| from 1.5 to 3 parts | of a blend of an alpha-hydroxyalkylphenone and benzophenone |
| from 0.5 to 1 part | of an acylphosphine oxide |
| and also optionally the following constituents | |
| from 0.6 to 1.0 part | of a silicone antifoam |
| from 0.3 to 0.5 part | of a fluorosurfactant-containing leveling agent |
| from 0.6 to 1.0 parts | of a polyether siloxane copolymer |
| from 2 to 5 parts | of water |
| from 2 to 4 parts | of butyl glycol as film-forming aid |
| from 0.4 to 0.8 part | of a polyurethane thickener |

| Adhesive composition 4 (UV-curable, unpigmented) | |
|---|---|
| from 25 to 45 parts | of a self-crosslinking aqueous acrylate dispersion (50% by weight) |

-continued

| | |
|---|---|
| from 10 to 20 parts | of a radiation-curable aqueous polyether urethane acrylate dispersion (from 40 to 50% by weight) |
| from 3 to 10 parts | of epoxy acrylate, water-dilutable |
| from 1 to 5 parts | of a fumed silica or of a combination of a fumed silica and of an amorphous synthetic silicate |
| from 1 to 6 parts | of a nonionic wax dispersion |
| from 2 to 10 parts | of a wax, e.g. carnauba wax, polyethylene wax, a combination of carnauba wax and polyethylene wax, or a combination of a plurality of polyethylene waxes |
| from 1 to 3 parts | of a blend of an alpha-hydroxyalkylphenone and benzophenone |
| from 0.5 to 1 part | of an acylphosphine oxide |
| and also optionally the following constituents | |
| from 0.2 to 1.0 part | of polyether siloxane copolymer |
| from 1 to 10 parts | of hydroxystyrene acrylate copolymer |
| from 0.1 to 5 parts | of plasticizer, e.g. triethyl citrate |
| from 0.5 to 5 parts | of water |
| from 0.5 to 5 parts | of butyl glycol as film-forming aid |
| from 0.01 to 1 part | of base, e.g. an organic amine |

| Adhesive composition 5 (UV-curable, pigmented) | |
|---|---|
| from 25 to 45 parts | of a self-crosslinking aqueous acrylate dispersion (50% by weight) |
| from 5 to 20 parts | of a radiation-curable aqueous polyether urethane acrylate dispersion (from 40 to 50% by weight) |
| from 3 to 10 parts | of epoxy acrylate, water-dilutable |
| from 5 to 25 parts | of colored pigment, e.g. titanium dioxide or chromatic pigment |
| from 1 to 8 parts | of a fumed silica or of an amorphous synthetic silica or of a combination of a fumed silica and of an amorphous synthetic silicate |
| from 1 to 6 parts | of a nonionic wax dispersion |
| from 2 to 10 parts | of a wax, e.g. carnauba wax, polyethylene wax, a combination of carnauba wax and polyethylene wax, or a combination of a plurality of polyethylene waxes |
| from 1 to 10 parts | of hydroxystyrene acrylate copolymer |
| from 1 to 3 parts | of a blend of an alpha-hydroxyalkylphenone and benzophenone |
| from 0.5 to 1 part | of an acylphosphine oxide |
| and also optionally the following constituents | |
| from 0.1 to 1.5 parts | of plasticizer, e.g. triethyl citrate |
| from 0.2 to 1.0 part | of a polyether siloxane copolymer |
| from 0.2 to 1.0 part | of an antifoam, e.g. of a silicone antifoam or of a siloxane-free antifoam |
| from 0.3 to 0.5 part | of a leveling aid, e.g. a fluorosurfactant-containing leveling agent |
| from 0.5 to 5 parts | of water |
| from 0.5 to 5 parts | of butyl glycol as film-forming aid |
| from 0.01 to 1 part | of base, e.g. of an organic amine |

| Adhesive composition 6 (UV-curable, unpigmented) | |
|---|---|
| from 30 to 70 parts | of a polyester urethane dispersion (40% by weight) |
| from 10 to 50 parts | of a radiation-curable aqueous polyether urethane acrylate dispersion (40-50% by weight) |
| from 1.5 to 3 parts | of a blend made of an alpha-hydroxyalkylphenone and benzophenone |
| from 0.5 to 1 part | of an acylphosphine oxide |
| and also optionally the following constituents | |
| from 0 to 20 parts | of water |
| from 0.8 to 1.5 parts | of a polysiloxane antifoam |
| from 0.4 to 1.2 parts | of a polyether siloxane copolymer |
| from 0.5 to 1.0 part | of a fluorosurfactant-containing leveling agent |
| from 0.01 to 0.5 | part of a polyurethane thickener |

| Adhesive composition 7 (UV-curable, unpigmented) | |
|---|---|
| from 15 to 60 parts | of a polyester urethane dispersion (40% by weight) |
| from 15 to 60 parts | of a self-crosslinking aqueous acrylate dispersion (50% by weight) |
| from 10 to 50 parts | of a radiation-curable aqueous polyether urethane acrylate dispersion (40-50% by weight) |

-continued

| | |
|---|---|
| from 1.5 to 3 parts | of a blend made of an alpha-hydroxyalkylphenone and benzophenone |
| from 0.5 to 1 part | of an acylphosphine oxide |
| and also optionally the following constituents | |
| from 0 to 20 parts | of water |
| from 0.8 to 1.5 parts | of a polysiloxane antifoam |
| from 0.4 to 1.2 parts | of a polyether siloxane copolymer |
| from 0.5 to 1.0 part | of a fluorosurfactant-containing leveling agent |
| from 0.01 to 0.5 | part of a polyurethane thickener |

It can moreover be desirable that the adhesive layer(s) and/or the layer(s) of coating material are of colored design. For this purpose, (a) layer(s) of coating material and/or the adhesive layer(s) can comprise one or more colorant constituents such as organic and/or inorganic pigments or dyes. Examples of these pigments are titanium dioxide as white pigment, and also iron oxide pigments such as iron oxide yellow, iron oxide red, iron oxide black, black pigments such as carbon black, phthalocyanine pigments such as Heliogen Blue or Heliogen Green, bismuth pigments such as bismuth vanadate yellow and diketopyrrolopyrrol red. For metallization effects, the material can also comprise metal pigments such as iron pigments, pearl-luster pigments, and aluminum pigments. Preferred pigments typically have particle sizes in the range from 0.1 to 100 μm, in particular in the range from 1 to 50 μm.

The thicknesses of adhesive layers are typically in the range from 5 to 25 μm.

The thermal transfer foils of the invention naturally have at least one backing foil, arranged on which is the at least one layer of coating material. The backing foils are generally plastic foils made of flexible thermoplastic polymers. In particular, the materials here are polyester foils, polyamide foils, polypropylene foils, foils made of polyvinyl alcohol, or polyesteramide foils. The materials known as coextrudate foils are also suitable, these being foils composed of a plurality of layers, where the plastics material in the individual layers can be different. It is preferable that the plastics material which forms the backing foil is predominantly amorphous. Waxed or siliconized papers are also suitable. The thickness of the backing foil (2) is preferably in the range from 3 to 200 μm, in particular from 10 to 100 μm, and specifically from 20 to 50 μm. Thin backing foils with thicknesses in the range from 3 to 30 μm are also suitable.

The surface structure of the backing foil which has the layer of coating material arranged thereon naturally determines the degree of gloss of the layer of coating material obtained in the coating process of the invention. Smooth surfaces lead to glossy or high-gloss surfaces, whereas matte effects can be achieved by using rough surfaces. It is also possible, by using a high level of structuring of the surface, to produce relatively coarse structures in the surface of the coating material.

That surface of the backing foil which has the layer of coating material arranged thereon can have a conventional release layer which facilitates the removal of the layer of coating material from the backing foil in the coating process of the invention.

Production of the thermal transfer foils can be achieved by analogy with conventional foil coating technologies which are also described in the prior art cited in the introduction, with the difference that the production of the layer of coating material uses no thermal drying step, and instead the liquid layer of coating material obtained by application of the non-aqueous radiation-curable, liquid composition to the backing foil is at least to some extent hardened by treatment with high-energy radiation such as electron beams or UV radiation.

The application of the non-aqueous, radiation-curable, liquid composition to the backing foil in step i) of the process of the invention can take place in a manner known per se, for example by doctoring, rolling, casting, or spraying. A coating of the radiation-curable composition on the backing foil is thus obtained, and can then be hardened by treatment with high-energy radiation. The amount applied is generally selected so as to give a layer thickness in the abovementioned ranges. The amount applied is generally in the range from 10 to 120 g/m$^2$, in particular in the range from 30 to 80 g/m$^2$, and in the case of a plurality of layers preferably in the range from 10 to 100 g/m$^2$ and in particular from 20 to 70 g/m$^2$.

In step ii) of the process of the invention, the coating obtained in step i) is then at least to some extent hardened by means of high-energy radiation. A decorative layer can optionally be applied to the unhardened or partially hardened coating prior to complete hardening. The adhesive layer can likewise optionally be applied prior to hardening. It is preferably that in step ii) of the process of the invention the coating obtained in step i) is only partially hardened. However the layer obtained in step i) will be at least to some extent hardened prior to application of the heat-sealable, polymeric adhesive layer and prior to the optional application of the decorative layer.

For the curing in step ii), the coating obtained in step i) is irradiated with high-energy radiation. The irradiation can take place through the backing foil or by direct irradiation of the coating. Preference is given to the direct irradiation.

The irradiation can be achieved by means of electron beams or with UV light, for example with UV lamps or with light-emitting diodes that emit UV radiation. It is preferable to use UV radiation for the curing in step ii). In particular, UV radiation in the wavelength range from 200 to 400 nm is used. It is preferable to use medium-pressure or high-pressure mercury lamps for this purpose. In many cases, gallium- or iron-doped high-pressure mercury sources are used.

The manner of irradiation in step ii) is preferably such that polymerization of the ethylenically unsaturated double bonds comprised in the non-aqueous, radiation-curable, liquid composition takes place only to some extent. The radiation density required for this purpose can be determined by the person skilled in the art through routine experimentation.

The irradiation in step ii) typically takes place at a radiation density in the range from 80 to 2000 J/m$^2$, in particular in the range from 110 to 400 J/m$^2$.

The curing in step ii) can take place in air or in an oxygen-depleted atmosphere with residual oxygen concentrations below 2000 ppm, e.g. with residual oxygen concentrations in the range from 50 to 1000 ppm. It is preferable that the curing takes place in air.

To the extent that the thermal transfer foil of the invention has a plurality of layers of coating material, the individual layers of coating material can by way of example be applied by liquid-in-liquid application methods, where the second layer of coating material and any further layers of coating material is/are applied to the first coating that is still liquid prior to hardening. However, it is preferable that the first layer of coating material is at least to some extent hardened by high-energy radiation prior to application of the further layer(s) of coating material.

A decorative layer is optionally applied to the layer of coating material prior to application of the adhesive layer, or else to the first layer of coating material in the event that there is a plurality of layers of coating material. Said decorative layer can be applied in a manner known per se by suitable printing processes, for example by flatbed, intaglio, inkjet, or digital printing. It is preferable that the layer of coating material is to some extent hardened prior to application of the decorative layer, where the partial curing is preferably carried out only to the extent that just permits application of the decorative layer. The printing inks used for the production of the decorative layer can be conventional printing inks or UV-curing printing inks.

The application of the heat-sealable adhesive layer in step iv) of the process of the invention can take place in a manner known per se. For this, a liquid adhesive composition, in particular an aqueous adhesive composition, will generally be applied in a conventional manner, for example by doctoring, rolling, casting, or spraying, to the layer of coating material or to the decorative layer. The adhesive layer is then dried, for example by heat. The amount applied of the liquid adhesive composition is generally selected in such a way as to give, after drying, a layer thickness in the abovementioned ranges. The amount applied is generally in the range from 5 to 50 g of solid per $m^2$, in particular in the range from 5 to 15 g of solid per $m^2$.

By way of example, the process of the invention can produce the following foil structures 1 to 12 by using the steps stated for each structure. Foil structures 7 to 12 here correspond to foil structures 1 to 6 except that a pigment-containing adhesive composition is used.

Foil structure 1:
1. Provision of a backing foil;
2. Coating of the backing foil with a liquid, radiation-curable, abrasive-free, colorless composition;
3. Partial curing of the layer of coating material by means of UV radiation;
4. Application of a water-based, pigment-free adhesive composition with radiation-curable constituents;
5. Thermal drying in air.

Foil structure 2:
1. Provision of a backing foil;
2. Coating of the backing foil with a liquid, radiation-curable, abrasive-free composition;
3. Partial curing of the layer of coating material by means of UV radiation;
4. Application of a decorative layer by means of intaglio print or digital print with use of a UV-curable printing ink;
5. Drying of the decorative layer by means of UV radiation;
6. Application of a water-based, pigment-free adhesive composition with radiation-curable constituents to the decorative layer;
7. Thermal drying in air.

Foil structure 3:
1. Provision of a backing foil;
2. Coating of the backing foil with a liquid, radiation-curable, abrasive-free, color-pigment-containing composition;
3. Partial curing of the colored layer of coating material by means of UV radiation;
4. Application of a water-based, pigment-free adhesive composition with radiation-curable constituents to the layer of coating material;
5. Thermal drying in air.

Foil structure 4:
1. Provision of a backing foil;
2. Coating of the backing foil with a liquid, radiation-curable, corundum-containing composition;
3. Drying of the colored layer of coating material by means of UV radiation;
4. Application of a water-based, pigment-free adhesive composition with radiation-curable constituents to the layer of coating material;
5. Thermal drying in air.

Foil structure 5:
1. Provision of a backing foil;
2. Coating of the backing foil with a liquid, radiation-curable, corundum-containing, composition;
3. Partial curing of the layer of coating material by means of UV radiation;
4. Application of a decorative layer by means of intaglio print or digital print with use of a UV-curable printing ink;
5. Drying of the decorative layer by means of UV radiation;
6. Application of a water-based, pigment-free adhesive composition with radiation-curable constituents to the decorative layer;
7. Thermal drying in air.

Foil structure 6:
1. Provision of a backing foil;
2. Coating of the backing foil with a liquid, radiation-curable, abrasive-containing, color-pigment-containing composition;
3. Partial curing of the colored layer of coating material by means of UV radiation;
4. Application of a water-based, pigment-free adhesive composition with radiation-curable constituents to the layer of coating material;
5. Thermal drying in air.

The resultant thermal transfer foils can then be further processed conventionally, e.g. wound up to give rolls.

The thermal transfer foils of the invention are particularly suitable for the dry coating of surfaces of articles. As already described in the introduction, heat and/or pressure is/are used here to transfer the layer(s) of coating material to the surface that requires coating on the article, hereinafter also termed substrate, where after irradiation the adhesive layer provides a good adhesive bond between the layer(s) of coating material and the substrate. The use of the thermal transfer foils of the invention is not restricted to certain substrates, but instead the foils can be used in a very versatile manner not only with hard substrates but also with resilient substrates.

The substrates can by way of example be articles made of plastic, for example made of ABS, polycarbonate, melamine, polyester, inclusive of glassfiber-reinforced polyesters, rigid PVC, flexible PVC, rubber, wood, inclusive of exotic natural timbers, wood-based materials, e.g. veneer, MDF, HDF, fine particleboard, or multiplex board, mineral fibers, e.g. mineral-fiberboard, paper, textile, inclusive of synthetic leathers, metal, or plastics-coated materials. The thermal transfer foils of the invention are preferably suitable for smooth, preferably flat or slightly curved surfaces. However, structures of greater complexity can also in principle be coated by this method. The substrates requiring coating can be undecorated or can already have decorative surfaces. The thermal transfer foils of the invention can particularly advantageously be used for coating of exotic natural timbers which often pose problems in wet coating processes because the ingredients exude, or there are resultant adhesives problems. The articles coated with use of the thermal transfer foils of the invention, e.g. wood fiberboard, MDF, or board made of natural wood, primed with use of the thermal transfer foils of the invention, can easily be further coated with a conventional UV coating material, with no need for any intermediate abrasive process. Alternatively an article thus primed can also be dry-coated with a thermal transfer foil of the invention.

The thermal transfer foils of the invention permit almost waste-free coating of articles. A change from colorless to colored or from matte to glossy can take place very rapidly during industrial manufacture without any requirement for a cleaning step within said changeover. Drying times are eliminated, and further processing can take place immediately after the coating process, an example being a conventional application of coating material, or packaging of the coated article. The backing foil can be removed or can initially remain as protective foil on the coated surface. Unlike conventional coating processes, the use of the thermal transfer foils of the invention permits dust-free coating. Furthermore, space requirement and personal cost are very much lower than for conventional coating processes.

The thermal transfer foils of the invention are unlike the thermal transfer foils known from the prior art in providing particularly high quality, in particular high scratch- and abrasion-resistance values: by way of example, surfaces in quality classes AC3 to AC4 (DIN EN 13329) can be achieved. The surfaces obtained with use of the thermal transfer foils of the invention regularly exhibit values above 20 N in the Hamberger plane test. The resultant surfaces regularly comply with the requirements of the highest-performance group in the DIN 68861 furniture standard.

The thermal transfer foils of the invention are typically used for the coating of surfaces of articles in a process which comprises the abovementioned steps a) to d), which are described in more detail hereinafter, and which can be carried out by analogy with the procedure described in EP 2078618 A2. The content of EP 2078618 A2 that is relevant here is hereby incorporated by way of reference.

In this process, the thermal transfer foil of the invention is first applied to the surface of the substrate requiring coating, and is then heat-sealed. The heat-sealing typically takes place with application of pressure in suitable presses, where the temperature of the press is typically in the range from 100 to 205° C., preferably in the range from 160 to 220° C. Preference is given to roll presses, since this method requires only brief contact, and the object temperature here does not therefore exceed a value of 70° C., in particular of 60° C. It is thus also possible to coat heat-sensitive substrates.

The substrate thus coated is then irradiated with high-energy radiation, i.e. with UV radiation or electron beams, whereupon the layer of coating material hardens completely. The irradiation can be carried out before removal of the backing foil or thereafter. For many applications it is advantageous to carry out the irradiation before removal of the backing foil, since the backing foil then remains as protective foil on the coated substrate.

The irradiation can be achieved by means of electron beams, e.g. with the use of gallium sources, or with UV light, for example with UV lamps or with light-emitting diodes that emit UV radiation. It is preferable that UV radiation is used for the curing in step ii). In particular, UV radiation in the wavelength range from 200 to 400 nm is used. For this purpose, it is preferable to use medium- or high-pressure mercury lamps. In many cases, gallium- or iron-doped high-pressure mercury sources are used. The irradiation in step ii) typically takes place with a radiation density in the range from 40 to 2000 J/m$^2$, in particular in the range from 100 to 400 J/m$^2$.

A system for conducting the process of the invention comprises at least one conventionally used thermal transfer apparatus which preferably has an apparatus for separation by cutting and/or a wind-up apparatus for the backing foil. If the intended usage of the finished coated article requires this, the system can have a first thermal transfer apparatus which primes the article and a second thermal transfer apparatus which gives the article its final coating.

A conventional thermal transfer apparatus can have the following structure: the thermal transfer foil wound up in the form of a roll is conducted from a foil-unwind device to a heated roll press which has at least one driven, heated, optionally rubber-coated roll which is optionally height-adjustable. The roll press generally has, opposite to the heated roll, a counterpressure roll, which can be a rubber-coated roll. This brings about the necessary pressure by means of which the layer of coating material is transferred, by means of the adhesive layer, to the surface of an article which is passed between the two rolls. The design of the counterpressure roll can be such that it brings about the separation of the backing foil from the layer of coating material. Once the backing foil has been separated from the material, it can be removed by using an apparatus for separation by cutting, or can be passed onward to a foil-wind-up device. It is also possible to use, instead of a roll press, a platen press, which is opened after a predetermined time.

The coated side of the coated article is then conducted past a source of high-energy radiation, for example an electron source or a UV source, and the coated side of the article is thus exposed to high-energy radiation, and final curing is achieved. The article thus coated is then passed onward to a collection apparatus, for example a stacking apparatus. Prior to or after irradiation, the backing foil can be removed by an apparatus for separation by cutting, or passed onward to a foil-wind-up device.

After removal of the backing foil, and prior to or after the curing by means of high-energy radiation, the article coated in the thermal transfer apparatus can also be introduced into another thermal transfer apparatus, in which a further layer of coating material is applied by means of a further thermal transfer foil of the invention to the coated surface of the article. It is preferable that the application of the further layer of coating material is followed by curing with high-energy radiation as described previously.

A first embodiment of an apparatus for the continuous realization of the process of the invention with solid substrates has a conveyor belt on which material can be placed, an unwind unit for the thermal transfer foil wound up in the form of a roll, a thermal transfer apparatus with roll press, as described previously, a wind-up apparatus for the backing foil, and a drying tunnel with UV source, and has an outgoing belt and a stacking device.

The substrates to be coated, preferably sheets, are placed on the conveyor belt and conducted at the desired advance rate through the thermal transfer apparatus. Here, the layer of coating material is transferred to the substrate, and the backing foil is removed and taken up by the wind-up apparatus. The layer of coating material is then hardened in the drying tunnel. The arrangement can also have the wind-up unit after the drying tunnel, so that the backing foil initially remains on the substrate, where it acts as protective foil.

A second embodiment of an apparatus for the continuous realization of the process of the invention with resilient substrate has an unwind unit for the substrate, an unwind unit for the thermal transfer foil wound up in the form of a roll, a thermal transfer apparatus with roll press, as described above, a drying tunnel with UV source, and a wind-up apparatus for the coated substrate.

The substrate to be coated is conducted together with the thermal transfer foil through the thermal transfer apparatus at the desired advance rate. Here, the thermal transfer foil is bonded to the substrate. The substrate thus coated is then conducted through the drying tunnel, the layer of coating material thus being hardened, and is taken up by the wind-up unit. After the trimming process, the backing foil can be removed.

A third embodiment of an apparatus for the continuous realization of the process of the invention with solid substrates has a conveyor belt, an unwind unit for the thermal transfer foil wound up in the form of a roll, a thermal transfer apparatus with heated platen press, and optionally a wind-up apparatus for the backing foil, or a cutting apparatus.

The substrates to be coated, preferably sheets, are placed on the conveyor belt and conducted into the platen press together with the thermal transfer foil. The press is closed, and the desired pressure is applied thereto. Here, the layer of coating material is transferred to the substrate. After opening of the press, the substrate is moved out of the press and passed through the drying tunnel, the layer of coating material thus being hardened. The backing foil can remain on the substrate here and serve as protective foil. In this case, the backing foil can be cut by a cutting apparatus before or after the drying tunnel. Alternatively, it is possible to remove the entire foil before the UV tunnel and pass it onward to the wind-up apparatus.

Another embodiment of an apparatus for the batchwise conduct of the process of the invention with solid substrates has a conveyor belt, an unwind unit for the thermal transfer foil wound up in the form of a roll, a cutting apparatus, a thermal transfer apparatus with heated platen press, and a drying tunnel with UV source.

The substrate to be coated is placed on the conveyor belt. The desired length of the thermal transfer foil is unwound, placed with the adhesive layer on the substrate to be coated, and separated by cutting. Substrate and foil are conducted into the platen press. The press is closed, and the desired pressure is applied thereto. Here, the layer of coating material is transferred to the substrate. After opening of the press, the coated substrate is moved out of the press and passed through the drying tunnel, the layer of coating material thus being hardened. The backing foil can remain on the substrate here and serve as protective foil. Alternatively, it is possible to remove the foil before the UV tunnel.

For further details in this connection, reference is particularly made to FIGS. 2 to 6 of EP 2078618 A2 and to the explanations given there.

The examples below serve for illustration of the invention:

I. Materials used for Radiation-Curable Composition

Urethane acrylate, diluted with 35% by weight of dipropylene glycol diacrylate, functionality 2.0: Laromer® UA9065 from BASF SE Aliphatic urethane acrylate 1, diluted with 35% by weight of dipropylene glycol diacrylate: Laromer® UA19T from BASF SE Aliphatic urethane acrylate 2, diluted with 30% by weight of trimethylolpropane formal monoacrylate, functionality 1.7: Laromer® UA9033 from BASF SE Aliphatic urethane acrylate 3, diluted with 30% by weight of hexanediol diacrylate: Laromer® LR 8987 from BASF SE Polyester acrylate 1, functionality 3.3, hydroxyl number 70: Laromer® PE9084 from BASF SE Polyester acrylate 2, functionality 3.2, hydroxyl number 50: Laromer® PE9074 from BASF SE Polyester acrylate 3, functionality 3.1, hydroxyl number 70: Laromer® PE55F from BASF SE Polyester acrylate 4, functionality 2.5, hydroxyl number 60, blended with 20% by weight of tripropylene glycol diacrylate: Laromer® PE9045 from BASF SE Phenoxyethyl acrylate: Laromer® POEA from BASF SE Trimethylolpropane formal monoacrylate: Laromer® LR8887 from BASF SE Trimethylolpropane triacrylate: Laromer® TM PTA from BASF SE Dipropylene glycol diacrylate (DPGDA)

Fumed silica: ACE Matt TS 100 from Evonik Industries AG

Matting agent based on silica (Syloid ED 80)

Aluminum oxide: Alodur ZWSK F320/280 from Treibacher

Corundum 1: Alodur F280 from Treibacher

Corundum 2: Alodur F320 from Treibacher

Synthetic silica: Syloid® RAD 2005 from Grace

Synthetic, organically modified silica: Gasil® UV 70C

Polyether siloxane: Tego Glide 435 from Evonik Industries AG

Deaerator concentrate: Tego Airex 920 from Evonik alpha-Hydroxyalkylphenone: Irgacure® 184 from BASF SE Acylphosphine oxide: Irgacure® 2100 from BASF SE Phenylglyoxylate: Irgacure® MBF from BASF SE Triazine-based UV absorber: mixture of 2-[4-[(2-hydroxy-3-dodecyloxy-propyl)oxy]-2-hydroxyphenyl]-4,6-bis(2,4-dimethylphenyl)-1,3,5-triazine and 2-[4-[(2-hydroxy-3-tridecyloxypropyl)oxy]-2-hydroxyphenyl]-4,6-bis(2,4-dimethyl-phenyl)-1,3,5-triazine UV stabilizer (HALS): mixture of bis(1,2,2,5,5-pentamethyl-4-piperidyl) sebacate and methyl 1,2,2,5,5-pentamethyl-4-piperidyl sebacate The abovementioned raw materials were mixed to produce the following radiation-curable coating formulations 1 to 7:

Coating Formulation 1:

| Raw material | Amount [% by wt.][1)] |
|---|---|
| Urethane acrylate, diluted with 35% by weight of dipropylene glycol diacrylate, functionality 2.0 | 30.0 |
| Polyester acrylate 1, functionality 3.3 | 9.0 |
| Trimethylolpropane formal monoacrylate | 9.8 |
| Trimethylolpropane triacrylate | 13.0 |
| Aliphatic urethane acrylate 2, diluted with 30% by weight of trimethylolpropane formal monoacrylate, functionality 1.7 | 8.5 |
| Aluminum oxide (corundum) | 25.0 |
| Deaerator concentrate | 0.5 |
| Fumed silica | 1.0 |
| Phenylglyoxylate | 1.6 |
| Acylphosphine oxide | 0.4 |
| alpha-Hydroxyalkylphenone | 1.0 |

[1)]Based on the total weight of the composition

Coating Formulation 2:

| Raw material | Amount [% by weight][1)] |
|---|---|
| Urethane acrylate, diluted with 35% by weight of dipropylene glycol diacrylate, functionality 2.0 | 37.0 |
| Aliphatic urethane acrylate 2, diluted with 30% by weight of trimethylolpropane formal monoacrylate, functionality 1.7 | 24.7 |
| Phenoxyethyl acrylate | 24.7 |
| Synthetic silica | 6.0 |
| Synthetic, organically modified silica | 2.5 |
| Fumed silica | 1.0 |
| Polyether siloxane | 0.6 |
| Deaerator concentrate | 0.5 |
| Phenylglyoxylate | 1.0 |
| Acylphosphine oxide | 0.2 |
| alpha-Hydroxyalkylphenone | 0.9 |
| Benzophenone | 0.9 |

[1)]Based on the total weight of the composition

Coating Formulation 3:

| Raw material | Amount [% by weight][1)] |
|---|---|
| Polyester acrylate 2 | 33.4 |
| Trimethylolpropane triacrylate | 14.3 |
| Polyester acrylate 3 | 10.3 |
| Trimethylolpropane formal monoacrylate | 10.5 |
| Phenoxyethyl acrylate | 11.0 |
| Polyester acrylate 4 | 10.0 |
| Deaerator concentrate | 0.5 |
| Phenylglyoxylate | 1.6 |
| Acylphosphine oxide | 0.4 |
| alpha-Hydroxyalkylphenone | 1.0 |

[1)]Based on the total weight of the composition

Coating Formulation 4:

| Raw material | Amount [% by weight][1)] |
|---|---|
| Aliphatic urethane acrylate 3, diluted with 30% by weight of hexanediol diacrylate | 80 |
| Dipropylene glycol diacrylate | 10 |
| Silicone antifoam | 0.35 |
| Matting agent based on silica | 7.0 |
| Phenylglyoxylate | 1.3 |
| Acylphosphine oxide | 1.35 |

[1)]Based on the total weight of the composition

Coating Formulation 5:

| Raw material | Amount [% by weight][1)] |
|---|---|
| Urethane acrylate, diluted with 35% by weight of diproylene glycol diacrylate, functionality 2.0 | 26.0 |
| Aliphatic urethane acrylate 2, diluted with 30% by weight of trimethylolpropane formal monoacrylate | 8.5 |
| Polyester acrylate 1 | 8.0 |
| Trimethylolpropane formal monoacrylate | 7.0 |
| Phenoxyethyl acrylate | 7.0 |
| Trimethylolpropane triacrylate | 11.0 |
| Matting agent based on silica | 5.0 |
| Corundum 1 | 15.0 |
| Corundum 2 | 10.0 |
| Silicone antifoam | 0.3 |

-continued

| Raw material | Amount [% by weight][1)] |
|---|---|
| Rheology additive | 0.2 |
| Acylphosphine oxide | 2.0 |

[1)]Based on the total weight of the composition

Coating Formulation 6:

| Raw material | Amount [% by weight][1)] |
|---|---|
| Aliphatic urethane acrylate 1, diluted with 35% by weight of dipropylene glycol diacrylate | 34.0 |
| Aliphatic urethane acrylate 2, diluted with 30% by weight of trimethylolpropane formal monoacrylate | 11.5 |
| Polyester acrylate 1 | 10.0 |
| Trimethylolpropane formal monoacrylate | 11.0 |
| Phenoxyethyl acrylate | 10.0 |
| Trimethylolpropane triacrylate | 14.0 |
| Matting agent based on silica | 7.0 |
| Silicone antifoam | 0.3 |
| Acylphosphine oxide | 2.0 |

[1)]Based on the total weight of the composition

Coating Formulation 7:

| Raw material | Amount [% by weight][1)] |
|---|---|
| Aliphatic urethane acrylate 3, diluted with 30% by weight of hexanediol diacrylate | 77.0 |
| Hexanediol diacrylate | 12.0 |
| Matting agent based on silica | 5.0 |
| Triazine-based UV absorber | 2.0 |
| UV stabilizer | 1.0 |
| Silicone antifoam | 0.35 |
| Acylphosphine oxide | 1.3 |
| Phenylglyoxylate | 1.3 |

[1)]Based on the total weight of the composition

II. Materials Used for Adhesive Composition

Self-crosslinking, aqueous polyacrylate dispersion 1 (50% by weight): Acronal® A849S from BASF SE Self-crosslinking, aqueous multiphase polyacrylate dispersion 2 (48% by weight), minimum film-forming temperature 50° C.

Aqueous polyester urethane dispersion, 40% by weight, glass transition temperature <−50° C.

Aqueous polyether urethane acrylate dispersion 1 (40% by weight): Laromer® LR9005 from BASF SE Aqueous polyether urethane acrylate dispersion 2 (40% by weight): Syntholux® 1014 W from Synthopol Chemie Aliphatic epoxy acrylate: Laromer® LR 8765 from BASF SE Polyether siloxane emulsion: Tego® Wet 270 from Evonik Industries AG Polymeric fluorosurfactant: Tego® Twin from Evonik Industries AG Wetting additive 1: siloxane gemini surfactant Wetting additive 2: polyether siloxane Carnauba wax dispersion: CA 30 from Münzing Liquid Technologies GmbH Modified polyethylene wax, aqueous dispersion: Aquamat® 270 from Byk Chemie GmbH Fumed silica: ACE Matt TS 100, Evonik Industries AG Micronized polyethylene wax: Aquaflour® 400 from Byk Chemie GmbH Synthetic silica: Sylysia from Finma Chemie
Aqueous polyurethane dispersion: Ecrothan 90 from Ecronova Polymer GmbH
Dimethylpolysiloxane: Tego® Glide 482 from Evonik Industries AG
Styrene-acrylate copolymer: Acronal® S 813 from BASF SE
Triethyl citrate: Citrofol Al from Jungbunzlauer GmbH
alpha-Hydroxyalkylphenone: Irgacure® 184
Acylphosphine oxide: Irgacure® 2100
Bisacylphosphine oxide: Irgacure® 819 DW
Mixture of benzophenone and 1-hydroxycyclohexyl phenyl ketone
Antifoam: silicone-based emulsion
Thickener: aqueous thickener solution (Vocaflex)
Aqueous titanium dioxide paste: Luconyl® white 0022 from BASF SE Adhesive composition 1 was produced by mixing the constituents stated in the table below.

Adhesive Formulation 1:

| Raw material | Amount [% by weight][1)] |
|---|---|
| Self-crosslinking aqueous polyacrylate dispersion 1 | 39.0 |
| Aqueous polyether urethane acrylate dispersion 1 | 16.4 |
| Polyether siloxane emulsion | 0.44 |
| Polymeric fluorosurfactant | 0.35 |
| Carnauba wax dispersion | 1.20 |
| Modified polyethylene wax | 7.3 |
| Fumed silica | 1.5 |
| Synthetic silica | 1.3 |
| Micronized polyethylene wax | 1.7 |
| Polyurethane dispersion | 13.0 |
| Dimethylpolysiloxane | 0.4 |
| Aliphatic epoxy acrylate | 6.1 |
| Styrene-acrylate dispersion (50%) | 4.4 |
| Triethyl citrate | 1.75 |
| alpha-Hydroxyalkylphenone | 1.0 |
| Acylphosphine oxide | 0.7 |
| Benzophenone | 0.85 |
| Butyl glycol | 1.0 |
| Water | 1.0 |
| Amino alcohol | 0.17 |

[1)]Based on the total weight of the composition

Adhesive formulation 2 was produced by mixing the constituents stated in the table below.

Adhesive Formulation 2

| Raw material | Amount [% by weight][1)] |
|---|---|
| Self-crosslinking aqueous polyacrylate dispersion 2 | 30.5 |
| Aqueous polyether urethane acrylate dispersion 2 | 12.3 |
| Aliphatic epoxy acrylate | 6.0 |
| Titanium dioxide paste | 18.0 |
| Polyether siloxane emulsion | 0.5 |
| Polymeric fluorosurfactant | 0.4 |
| Carnauba wax dispersion | 1.2 |
| Modified polyethylene wax | 5.8 |
| Synthetic silica | 3.5 |
| Polyurethane dispersion | 11.0 |
| Styrene-acrylate dispersion (50%) | 4.0 |
| Triethyl citrate | 1.8 |
| alpha-Hydroxyalkylphenone | 1.0 |
| Acylphosphine oxide | 1.5 |
| Diacylphosphine oxide | 0.5 |
| Butyl glycol | 1.0 |
| Water | 1.0 |

[1)]Based on the total weight of the composition

Adhesive formulation 3 was produced by mixing the constituents stated in the table below.

Adhesive Formulation 3

| Raw material | Amount [% by weight][1)] |
|---|---|
| Aqueous polyester urethane dispersion | 57.5 |
| Aqueous polyether urethane acrylate dispersion 1 | 35.8 |
| Wetting additive 1 | 0.1 |
| Wetting additive 2 | 0.8 |
| Antifoam: | 0.1 |
| Acylphosphine oxide | 0.75 |
| Mixture of benzophenone and 1-hydroxycyclohexyl phenyl ketone | 2.0 |
| Thickener | 0.05 |

[1)]Based on the total weight of the composition

Adhesive formulation 4 was produced by mixing the constituents stated in the table below.

Adhesive Formulation 4

| Raw material | Amount [% by weight][1)] |
|---|---|
| Aqueous polyester urethane dispersion | 40.0 |
| Aqueous polyether urethane acrylate dispersion 1 | 23.5 |
| Self-crosslinking, aqueous multiphase polyacrylate dispersion 2 | 23.5 |
| Wetting additive 1 | 0.1 |
| Wetting additive 2 | 0.8 |
| Antifoam: | 0.1 |
| Acylphosphine oxide | 1.0 |
| Phenylglyoxylate | 1.0 |

[1)]Based on the total weight of the composition

III. Production of the Foil Materials of the Invention:

The irradiation procedure in the examples below used an apparatus in which the coated and, respectively, printed foil was conducted at a defined advance velocity past a Ga-doped mercury source with a power rating of 120 W/cm.

The foils of examples 1, 2 and 3 used a UV-curable intaglio ink based on an epoxy acrylate.

EXAMPLE 1: FOIL FOR USE AS COLOR COATING MATERIAL IN THE FURNITURE SECTOR

Coating formulation 4 was applied with a layer thickness of 40 g/m$^2$ to an uncolored polyethylene terephthalate backing foil with a layer thickness of 23 μm. The foil thus coated was conducted at an advance velocity of 30 m/min past the Ga-doped mercury source in order to gel the layer of coating material.

The UV-curable intaglio ink was then applied to the gelled layer of coating material. For curing, the foil thus printed was again conducted at an advance velocity of 30 m/min past the Ga-doped mercury source.

Adhesive formulation 3 was then applied with a layer thickness of 15 g/m$^2$ to the printed layer of coating material, and heat-dried.

EXAMPLE 2: FOIL FOR USE AS COLOR COATING MATERIAL IN THE FURNITURE SECTOR

Coating formulation 5 was applied with a layer thickness of 70 g/m$^2$ to an uncolored polyethylene terephthalate backing foil with a layer thickness of 23 μm. The foil thus coated was conducted at an advance velocity of 30 m/min past the Ga-doped mercury source in order to gel the layer of coating material.

The UV-curable intaglio ink was then applied to the gelled layer of coating material. For curing, the foil thus printed was again conducted at an advance velocity of 30 m/min past the Ga-doped mercury source.

Adhesive formulation 3 was then applied with a layer thickness of 15 g/m$^2$ to the printed layer of coating material, and heat-dried.

EXAMPLE 3: FOIL FOR USE AS CLEARCOAT MATERIAL IN THE FURNITURE SECTOR

Coating formulation 6 was applied with a layer thickness of 40 g/m$^2$ to an uncolored polyethylene terephthalate backing foil with a layer thickness of 23 μm. The foil thus coated was conducted at an advance velocity of 30 m/min past the Ga-doped mercury source in order to gel the layer of coating material.

Adhesive formulation 3 was then applied with a layer thickness of 15 g/m$^2$ to the printed layer of coating material, and heat-dried.

EXAMPLE 4: FOIL FOR USE AS COLOR COATING MATERIAL IN THE OUTDOOR SECTOR

Coating formulation 7 was applied with a layer thickness of 45 g/m$^2$ to an uncolored polyethylene terephthalate backing foil with a layer thickness of 23 μm. The foil thus coated was conducted at an advance velocity of 30 m/min past the Ga-doped mercury source in order to gel the layer of coating material.

The UV-curable intaglio ink was then applied to the gelled layer of coating material. For curing, the foil thus printed was again conducted at an advance velocity of 30 m/min past the Ga-doped mercury source.

Adhesive formulation 3 was then applied with a layer thickness of 15 g/m$^2$ to the printed layer of coating material, and heat-dried.

IV. Testing of the Foil Materials of the Invention:

a) Testing of the Crosslinking of the Adhesive Layer

The foil from example 3 was laminated to a sheet of beechwood by means of a heated roll (180° C., object temperature at most 50° C.). The foil thus laminated was then irradiated through the foil by conducting the laminated side at an advance velocity of 20 m/min past two UV sources (mercury source and Ga-doped mercury source) with respective power rating of 120 W/cm.

The resultant sample was studied by means of ATR-FTIR spectroscopy using a FT-IR spectrometer from Nicolet (Nicolet 380) and a Golden Gate® sample head. In comparison with an unirradiated sample, there was a significant discernible reduction of the absorption bands at 810 cm$^{-1}$ (>40%) and 1410 cm$^{-1}$ (>30%) characteristic of acrylate groups.

b) Testing of the Stability of the Coating

The following tests were undertaken:

T1: Water resistance (24 h) in accordance with DIN 68861-1:2011-01. Evaluation used a scale from 1 (poor) to 5 (good).

T2: Ethanol resistance (6 h) in accordance with DIN 68861-1:2011-01. Evaluation used a scale from 1 (poor) to 5 (good).

T3: Ethyl acetate resistance (10 s) in accordance with DIN 68861-1:2011-01. Evaluation used a scale from 1 (poor) to 5 (good).

T4: "Hamberger plane" test: in this test a tester similar to a coin is drawn across the surface to be tested at a prescribed angle with variable force. The test equipment allows continuously variable setting of the applied force. The force stated in newtons is the maximum force for which no surface damage is discernible.

T5: Scratch resistance in the diamond test in accordance with EN 438-2:2005. The maximum force applied without leaving any continuous surface scratches is stated as the numerical value.

T6: The crosscut test was carried out in accordance with DIN ISO 2409:2013. Evaluation used a scale from GTO (good adhesion) to GT5 (very severe breakaway of the coating).

T7: Abrasion resistance by the falling sand method in accordance with DIN EN 14354:2005-03

T8: Abrasion resistance by the S24 method in accordance with DIN 13329:2013-12

Table T collates the results of the tests T1-T8.

Sample 1:

The foil from example 1 was laminated with application of constant pressure to a sheet of MDF by means of a heated roll (180° C., object temperature at most 50° C.). The sheet thus laminated was then irradiated through the foil by conducting the laminated side at an advance velocity of 20 m/min past two UV sources (mercury source and Ga-doped mercury source) with respective power rating of 120 W/cm. The backing foil was then removed.

Comparative Sample Comp1:

For comparative purposes, the foil from example 1 was laminated with application of the same pressure to a sheet of MDF by means of a heated roll (180° C., object temperature at most 50° C.) but no subsequent irradiation was undertaken here.

Sample 2:

The production process was analogous to that for the production of sample 1, but the foil from example 2 was used instead of the foil from example 1.

Comparative Sample Comp2:

The production process was analogous to that for the production of comparative sample comp1, but the foil from example 2 was used instead of the foil from example 1.

Sample 3:

The foil from example 3 was laminated with application of constant pressure to a sheet of beechwood by means of a heated roll (180° C., object temperature at most 50° C.).

The sheet thus laminated was then irradiated through the foil by conducting the laminated side at an advance velocity of 20 m/min past two UV sources (mercury source and Ga-doped mercury source) with respective power rating of 120 W/cm. The backing foil was then removed.

Comparative Sample Comp3:

For comparative purposes, the foil from example 3 was laminated with application of the same pressure to a sheet of beechwood by means of a heated roll (180° C., object temperature at most 50° C.) but no subsequent irradiation was undertaken here.

Sample 4:

The foil from example 4 was laminated with application of constant pressure to a sheet of PVC by means of a heated roll (180° C., object temperature at most 50° C.). The sheet thus laminated was then irradiated through the foil by conducting the laminated side at an advance velocity of 15 m/min past two UV sources (mercury source and Ga-doped mercury source) with respective power rating of 120 W/cm. The backing foil was then removed.

Comparative Sample Comp4:

For comparative purposes, the foil from example 4 was laminated with application of the same pressure to a sheet of PVC by means of a heated roll (180° C., object temperature at most 50° C.) but no subsequent irradiation was undertaken here.

TABLE T

Results of tests T1-T8

| Sample | UV curing | T1 | T2 | T3 | T4 [N] | T5 [N] | T6 | T7 [rpm$^{-1}$] | T8 [rpm$^{-1}$] |
|---|---|---|---|---|---|---|---|---|---|
| 1 | yes | 5 | 5 | 5 | 20 | 1.2 | GT0 | n.d. | n.d. |
| 2 | yes | 5 | 5 | 5 | 19 | 1.0 | GT0 | 620 | 1600 |
| 3 | yes | 5 | 5 | 5 | 18 | 1.1 | GT0 | n.d. | n.d. |
| 4 | yes | 5 | 5 | 5 | 19 | 1.3 | GT1 | n.d. | n.d. |
| comp1 | no | 4-5 | 5 | 5 | 13 | 0.7 | GT5 | n.d. | n.d. |
| comp2 | no | 4-5 | 4-5 | 5 | 14 | 0.6 | GT4 | 630 | 1550 |
| comp3 | no | 4 | 4 | 5 | 13 | 0.7 | GT4 | n.d. | n.d. |
| comp4 | no | 5 | 5 | 5 | 13 | 0.7 | GT3 | n.d. | n.d. |

The results show that good adhesion can be achieved only when the adhesive layer comprises a radiation-curable constituent which is crosslinked via irradiation with UV after lamination. This method moreover obtains better surface hardness values.

The invention claimed is:

1. A thermal transfer foil (1) comprising:

a) a backing foil (2), b) at least one layer (3) of coating material arranged on the backing foil (2), c) at least one heat-sealable, polymeric adhesive layer (4), where the layer of coating material is based on a non-aqueous, radiation-curable, liquid composition which comprises at least 60% by weight, based on the total weight of the composition, of curable constituents selected from organic oligomers which have ethylenically unsaturated double bonds and mixtures of said oligomers with monomers which have at least one ethylenically unsaturated double bond, and where the heat-sealable polymeric adhesive layer (4) is based on at least two aqueous polymer dispersions, where at least one polymer dispersion comprises a UV-radiation-curable polymer in dispersed form, and where at least one other polymer dispersion comprises a self-crosslinking polymer in dispersed form.

2. The thermal transfer foil according to claim 1, wherein the radiation-curable composition which forms the layer of coating material comprises from 1.5 to 8 mols of ethylenically unsaturated double bonds per kg of the composition.

3. The thermal transfer foil according to claim 1, wherein the oligomers in the radiation-curable composition which forms the layer of coating material have an average of from 1.5 to 10, ethylenically unsaturated double bonds per molecule.

4. The thermal transfer foil according to claim 1, wherein the ethylenically unsaturated double bonds in the oligomers and in the monomers of the radiation-curable composition which forms the layer of coating material take the form of acrylic or methacrylic groups.

5. The thermal transfer foil according to claim 1, wherein the oligomers of the radiation-curable composition which forms the layer of coating material are selected from the group consisting of: polyether (meth)acrylates, polyester (meth)acrylates, epoxy (meth)acrylates, urethane (meth) acrylates, and unsaturated polyester resins, and mixtures of these.

6. The thermal transfer foil according to claim 5, wherein the radiation-curable composition which forms the layer of coating material comprises at least one oligomer selected from: polyester acrylates, urethane acrylates, and mixtures of these.

7. The thermal transfer foil according to claim 1, wherein the monomers are selected from esters of acrylic acid with mono- to hexahydric alcohols.

8. The thermal transfer foil according to claim 1, wherein the radiation-curable liquid composition comprises at least one photoinitiator which has an absorption band with a maximum $\lambda_{max}$ in the range from 220 to 420 nm.

9. The thermal transfer foil according to claim 1, wherein the thickness of the layer (3) of coating material is from 10 to 120 μm.

10. The thermal transfer foil according to claim 1, which has a decorative layer between the layer (3) of coating material and the adhesive layer (4).

11. A process for the production of a thermal transfer foil according to claim 1, comprising:

i. applying the non-aqueous, radiation-curable, liquid composition to provide a coating curable by high-energy radiation;

ii. irradiating, by high-energy radiation, the curable coating obtained in step i., where the layer (3) of coating material is obtained;

iii. optionally applying a decorative layer to the curable coating or to the layer (3) of coating material; and iv. applying the heat-sealable, polymeric adhesive layer (4).

12. The process according to claim 11, where the irradiation of the coating curable by high-energy radiation takes place is performed before the application of the adhesive layer and before the optional application of the decorative layer.

13. The process according to claim 11, where the manner of irradiation of the coating curable by high-energy radiation is sufficient to cause only partial polymerization of the ethylenically unsaturated double bonds comprised in the non-aqueous, radiation-curable, liquid composition.

14. A process for the coating of surfaces of articles, comprising:

a) applying of the thermal transfer foil (1) according to claim 1 with the adhesive layer to the surface requiring coating;

b) heat-sealing of the transfer foil, where a surface coated with the transfer foil is obtained;

c) irradiating, with UV radiation or electron beams, of the surface coated with the transfer foil;

d) optionally releasing the backing foil (2).

15. A method of dry coating an article comprising the use of a thermal transfer foil according to claim 1.

16. The thermal transfer foil according to claim 3, wherein the oligomers in the radiation-curable composition which forms the layer of coating material have an average of from 2 to 8 ethylenically unsaturated double bonds per molecule.

17. The thermal transfer foil according to claim 7, wherein the monomers are esters of acrylic acid with di- to tetrahydric aliphatic or cycloaliphatic alcohols.

18. The thermal transfer foil according to claim 1, where the UV-radiation-curable polymer is a polyether urethane acrylate.

* * * * *